US010113469B2

(12) United States Patent
Naidu et al.

(10) Patent No.: US 10,113,469 B2
(45) Date of Patent: Oct. 30, 2018

(54) METHOD OF PROTECTING A DIESEL PARTICULATE FILTER FROM OVERHEATING

(71) Applicant: FORD GLOBAL TECHNOLOGIES, LLC, Dearborn, MI (US)

(72) Inventors: Paspuleti Ashish Kumar Naidu, Basildon (GB); James Wright, Wanstead (GB); Peter George Brittle, Romford (GB); Matthew Mitchell, Billericay (GB)

(73) Assignee: Ford Global Technologies, LLC, Dearborn, MI (US)

( * ) Notice: Subject to any disclaimer, the term of this patent is extended or adjusted under 35 U.S.C. 154(b) by 95 days.

(21) Appl. No.: 15/233,514

(22) Filed: Aug. 10, 2016

(65) Prior Publication Data

US 2017/0044960 A1 Feb. 16, 2017

(30) Foreign Application Priority Data

Aug. 11, 2015 (GB) ..... 1514120.3

(51) Int. Cl.
*F01N 3/00* (2006.01)
*F01N 9/00* (2006.01)
(Continued)

(52) U.S. Cl.
CPC ..... *F01N 9/002* (2013.01); *F01N 3/021* (2013.01); *F01N 11/002* (2013.01); *F02B 63/04* (2013.01);
(Continued)

(58) Field of Classification Search
USPC ..... 60/274, 280, 286, 295, 297, 311
See application file for complete search history.

(56) References Cited

U.S. PATENT DOCUMENTS 6,672,050 B2 * 1/2004 Murata ..... B60K 6/485 60/284
6,829,888 B2 12/2004 Kuenstler et al.
(Continued)

FOREIGN PATENT DOCUMENTS

DE 4239357 C1 12/1993
EP 2444640 A1 4/2012
FR 2902832 A1 12/2007

OTHER PUBLICATIONS

Combined Search and Examination Report dated Mar. 2, 2016 in Application No. GB1514120.3.
(Continued)

*Primary Examiner* — Binh Q Tran
(74) *Attorney, Agent, or Firm* — David Kelley; Brooks Kushman P.C.

(57) ABSTRACT

A method for preventing overheating of a diesel particulate filter during regeneration when an engine is idling may include using an electric machine to apply a load to the engine and compensating for the increase in applied load by increasing an engine torque set point to reduce the concentration of Oxygen in the exhaust gas flowing to the diesel particulate filter. Increased engine torque may be provided by adjusting air-fuel ratio by enriching an air-fuel mixture supplied to the engine and the diesel particulate filter. The control may be initiated in response to entering an idle mode during regeneration or in response to a measured or estimated temperature of the diesel particular filter exceeding a threshold or limit. Estimated temperature may be predicted using a soot combustion model.

20 Claims, 3 Drawing Sheets

(51) Int. Cl.

| | |
|---|---|
| ***F02D 41/02*** | (2006.01) |
| ***F02D 41/08*** | (2006.01) |
| ***F02D 41/22*** | (2006.01) |
| ***F01N 3/021*** | (2006.01) |
| ***F01N 11/00*** | (2006.01) |
| ***F02B 63/04*** | (2006.01) |
| ***F02D 29/06*** | (2006.01) |
| ***F02D 41/06*** | (2006.01) |
| ***F02D 41/14*** | (2006.01) |
| ***F02N 11/04*** | (2006.01) |
| *F02D 41/12* | (2006.01) |

(52) U.S. Cl.

CPC ..... *F02D 29/06* (2013.01); *F02D 41/029* (2013.01); *F02D 41/064* (2013.01); *F02D 41/083* (2013.01); *F02D 41/1446* (2013.01); *F02D 41/22* (2013.01); *F02N 11/04* (2013.01); *F01N 2550/04* (2013.01); *F02D 41/12* (2013.01); *F02D 2041/0265* (2013.01); *F02D 2200/0802* (2013.01); *F02D 2200/0804* (2013.01); *F02D 2200/101* (2013.01); *F02D 2250/24* (2013.01)

(56) References Cited

U.S. PATENT DOCUMENTS

| | | | | |
|---|---|---|---|---|
| 7,584,607 | B2 * | 9/2009 | Samuelsen | B60K 6/26 60/274 |
| 8,277,363 | B2 * | 10/2012 | Lahti | B60W 10/06 477/100 |
| 8,424,293 | B2 | 4/2013 | Marlett et al. | |
| 8,438,841 | B2 * | 5/2013 | Bidner | F01N 3/023 60/274 |
| 2004/0123584 | A1 | 7/2004 | Schaller | |
| 2004/0123589 | A1 | 7/2004 | Ohtake et al. | |
| 2007/0017215 | A1 | 1/2007 | Matheaus et al. | |
| 2007/0193258 | A1 | 8/2007 | Berke | |
| 2007/0204601 | A1 | 9/2007 | Ishii et al. | |
| 2007/0246272 | A1 * | 10/2007 | Ogata | B60K 6/48 180/65.245 |
| 2008/0173010 | A1 | 7/2008 | Suresh et al. | |
| 2010/0005785 | A1 | 1/2010 | Breuer et al. | |
| 2011/0107741 | A1 | 5/2011 | LaRose, Jr. et al. | |
| 2013/0174536 | A1 | 7/2013 | Yacoub | |
| 2013/0179022 | A1 * | 7/2013 | Ueno | B60K 6/48 701/22 |

OTHER PUBLICATIONS

European Office Action for European Application No. 16275106.9 dated Jan. 19, 2017.

* cited by examiner

METHOD OF PROTECTING A DIESEL PARTICULATE FILTER FROM OVERHEATING

CROSS-REFERENCE TO RELATED APPLICATIONS

This application claims foreign priority benefits under 35 U.S.C. § 119(a)-(d) to GB 1514120.3 filed Aug. 11, 2015, which is hereby incorporated by reference in its entirety.

TECHNICAL FIELD

This disclosure relates to a diesel particulate filter arranged to receive exhaust gas from an engine of a motor vehicle and protecting the diesel particulate filter from overheating during a regeneration event when the engine is idling.

BACKGROUND

A diesel particulate filter (DPF) can be damaged during what is known as a 'drop to idle' scenario. This is the worst case thermal scenario for a DPF. If an engine of a vehicle drops to idle when the soot combustion process (regeneration process) has just commenced, the maximum potential energy in the form of soot exists in the DPF with the maximum oxygen content seen during engine running but also with the lowest exhaust mass flow to transfer the heat out of the DPF. Additionally, because the vehicle is not moving there is minimal external airflow for cooling the exhaust system from the outside.

Under these conditions the temperature within the DPF can rise to more than 1000° C. and it is possible to crack the DPF, melt the DPF substrate or degrade the catalyst washcoat which is present to aid the removal of other regulated emissions (HC, CO or NOx). In an extreme case this overheating condition can result in the DPF material combusting which can lead to thermal damage of surrounding components.

A temperature that is likely to result in damage to the diesel particulate filer is an unacceptably high temperature and the diesel particulate filter can be considered to be overheating when subject to such a temperature.

SUMMARY

According to one embodiment, a method of preventing overheating of a diesel particulate filter during a regeneration event when an engine of a motor vehicle to which the diesel particulate filter is connected is in an idle mode of operation includes, when regeneration of the diesel particulate filter is occurring, the engine is idling and one of a prediction of temperature and a sensed temperature indicates that the temperature within the diesel particulate filter is one of predicted and sensed to be unacceptably high, operating an electric machine drivingly connected to the engine in a generator mode and adjusting the fueling to the engine to compensate for the additional load applied to the engine by the electric machine.

Adjusting the fueling to the engine may comprise reducing an air-fuel ratio to increase the richness of the mixture supplied to the diesel particulate filter.

The method may further comprise checking the speed of the engine to confirm that the engine is operating in an idle mode.

The method may further comprise using a soot combustion model to predict the temperature within the diesel particulate filter and using the predicted temperature to determine whether the temperature of the diesel particulate filter is predicted to be unacceptably high.

Alternatively, the method may further comprise using a temperature sensor to measure one of the temperature within the diesel particulate filter and the temperature of the exhaust gas exiting the diesel particulate filter and using the measured temperature to determine whether the temperature within the diesel particulate filter is sensed to be unacceptably high. The temperature may be unacceptably high if it is above a predefined temperature limit.

In one embodiment, a motor vehicle includes a diesel engine, an electric machine drivingly connected to the engine, an electrical energy storage device connected to the electric machine, a diesel particulate filter arranged to receive exhaust gas from the engine and an electronic controller arranged to control the engine and the electric machine. When the engine is operating in an idle mode, regeneration of the diesel particulate filter is occurring, and the temperature within the diesel particulate filter is one of predicted and sensed to be unacceptably high, the electronic controller is arranged to operate the electric machine in a generator mode and adjust the fueling to the engine to compensate for the additional load applied to the engine by the electric machine.

Adjusting the fueling to the engine may comprise reducing an air-fuel ratio to increase the richness of (or enrich) the mixture supplied to the diesel particulate filter.

The vehicle may further comprise an engine speed sensor and the electronic controller may be further arranged to use an output from the engine speed sensor to establish whether the engine is operating in the idle mode.

The vehicle may further comprise a temperature sensor used to measure one of the temperature within the diesel particulate filter and the temperature of the exhaust gas exiting the diesel particulate filter and the electronic controller may be arranged to use the measured temperature to determine whether the temperature within the diesel particulate filter is sensed to be unacceptably high.

The electronic controller may include a soot combustion model for predicting the temperature within the diesel particulate filter and the electronic controller may be arranged to use the temperature predicted by the soot combustion model to determine whether the temperature within the diesel particulate filter is predicted to be unacceptably high. The temperature may be unacceptably high if it is above a predefined temperature limit.

In various embodiments, the electric machine may be an integrated starter-generator (ISG) and the vehicle may be a hybrid vehicle.

DETAILED DESCRIPTION

As required, detailed embodiments are disclosed herein; however, it is to be understood that the disclosed embodiments are merely representative and may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the claimed subject matter.

Figure 1:
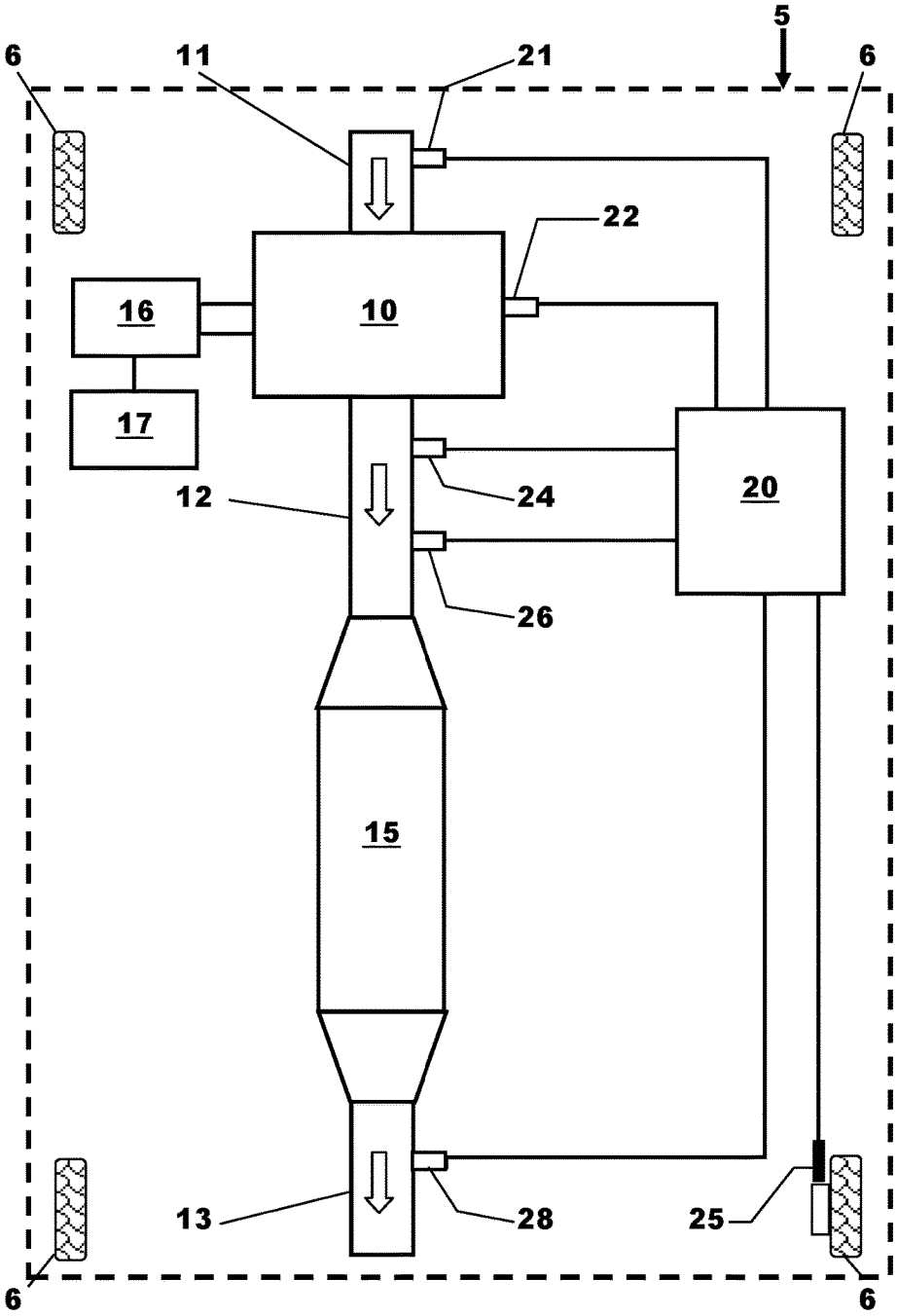
FIG. 1 is a schematic diagram of a motor vehicle constructed in accordance with an embodiment.

With reference to FIG. 1, a hybrid motor vehicle 5 includes four road wheels 6, a diesel engine 10 and an electronic controller 20. Control logic, functions, algorithms, or methods performed by controller 20 may be represented by flow charts or similar diagrams in one or more figures. These figures provide representative control strategies and/or logic that may be implemented using one or more processing strategies such as event-driven, interrupt-driven, multi-tasking, multi-threading, and the like. As such, various steps or functions illustrated may be performed in the sequence illustrated, in parallel, or in some cases omitted. Although not always explicitly illustrated, one of ordinary skill in the art will recognize that one or more of the illustrated steps or functions may be repeatedly performed depending upon the particular processing strategy being used. Similarly, the order of processing is not necessarily required to achieve the features and advantages described herein, but is provided for ease of illustration and description. The control logic may be implemented primarily in software executed by a microprocessor-based vehicle, engine, and/or powertrain controller, such as controller 20. Of course, the control logic may be implemented in software, hardware, or a combination of software and hardware in one or more controllers depending upon the particular application. When implemented in software, the control logic may be provided in one or more non-transitory computer-readable storage devices or media having stored data representing code or instructions executed by a computer to control the vehicle or its subsystems. The computer-readable storage devices or media may include one or more of a number of known physical devices which utilize electric, magnetic, and/or optical storage to keep executable instructions and associated calibration information, operating variables, and the like.

The engine 10 is arranged to receive air through an inlet 11 and in some embodiments the flow of air will be compressed by a supercharger or a turbocharger before it flows into the engine 10 to improve the efficiency of the engine 10.

Exhaust gas from the engine 10 flows through a first or upstream portion 12 of an exhaust system to a diesel particulate filter (DPF) 15 and after passing through the DPF 15, the exhaust gas flows out to atmosphere via a second or downstream portion 13 of the exhaust system. It will be appreciated that other emission control devices or noise suppression devices may be present in the gas flow path from the engine 10 to the position where it exits to atmosphere.

An electric machine is drivingly connected to the engine 10. In the case of this example the electric machine is an integrated starter-generator (ISG) 16 that can be used to generate electricity or generate torque depending upon the mode in which it is operating. A battery 17 is connected to the integrated starter-generator 16 along with associated control electronics (not shown). When the integrated starter-generator 16 is operating as a generator it charges the battery 17 and, when the integrated starter-generator 16 is operating as a motor, the battery 17 is arranged to supply electrical energy to the integrated starter-generator 16.

The integrated starter-generator 16 is used to start the engine 10 and in the case of this example is also able to provide a limited torque boost to the engine 10 during acceleration of the vehicle 5.

The electronic controller 20 receives inputs from a number of sensors such as a mass airflow sensor 21 used to measure the mass of air flowing into the engine 10, an engine speed sensor 22, a Lambda/Oxygen sensor 24 to measure the air-fuel ratio/Oxygen content of the exhaust gas exiting the engine 10, a vehicle speed sensor 25 to measure the speed of the vehicle 5, a NOx sensor 26 to measure the level of NOx in the exhaust gas from the engine 10 and a temperature sensor 28 to measure the temperature of the exhaust gas exiting the DPF 15.

The electronic controller 20 is operable to control the operation of the engine 10 and the operating state of the integrated starter-generator 16. It will be appreciated that the electronic controller 20 could be formed of several separate electronic units electrically connected together and need not be in the form of a single unit as shown in FIG. 1.

The electronic controller 20 is arranged to prevent overheating of the DPF 15 during a regeneration event when the engine 10 is in an idle mode of operation. In the idle mode of operation the engine 10 is rotating at a relatively low rotational speed and there is no torque demand from a driver of the vehicle 5. The fact that the engine is in the idle mode can be sensed by using the sensors associated with the engine 10 such as the engine speed sensor 22 or, if the electronic controller 20 includes an idle speed controller, the fact that idle speed control is active can be used to indicate that the engine 10 is idling.

Because the electronic controller 20 is arranged to operate the engine 10 in order to carry out a regeneration of the DPF 15 it is able to recognize when the engine 10 has entered the idle mode during such a period of regeneration.

The electronic controller 20 can then act immediately to control the temperature within the DPF 15 or can delay this temperature controlling function until the signal received by the electronic controller 20 from the exhaust gas temperature sensor 28 located downstream from the DPF 15 indicates that the temperature of the exhaust gas exiting the DPF 15 is excessive. That is to say, if the temperature of the exhaust gas measured by the temperature sensor 28 exceeds a predefined temperature limit ($T_{Lim}$), the electronic controller 20 acts to control the temperature within the DPF 15 but if the temperature of the exhaust gas exiting the DPF 15 is below this predefined temperature limit it takes no action but instead allows the regeneration of the DPF 15 to continue. The predefined temperature limit $T_{Lim}$ may be set to a temperature above which damage may occur such as, for example and without limitation, circa 850° C. It will be appreciated that the temperature sensed by the downstream temperature sensor 28 is not a measurement of the actual temperature within the DPF 15 but that the temperature within the DPF 15 can be inferred from this temperature measurement. The temperature within the DPF 15 is likely to be higher than this measured or modelled temperature.

It will be appreciated that instead of the downstream temperature sensor 28 a temperature sensor able to measure the temperature within the DPF 15 could be used and, in such a case, the predefined temperature limit could be set higher than 850° C. such as, for example, 950° C.

Assuming that the determination of the electronic controller 20 is that the temperature within the DPF 15 is excessive and requires controlling, the electronic controller 20 is arranged to use the integrated starter-generator 16 to apply a load to the engine 10 by operating it as a generator. This would normally result in the speed of the engine 10 dropping due to the additional load applied to it by the integrated starter-generator 16. However, to counteract this drop in speed, the engine torque set point for the engine 10 is increased by the electronic controller 20 in order to maintain the required idle speed. If an idle speed controller is present then this action may be an automatic response by the idle speed controller to a drop in engine speed.

Increasing the engine torque set point will result in the engine running richer than normal and so the quantity of Oxygen flowing to the DPF 15 will drop. For example under normal idle mode conditions the oxygen content of the exhaust gas entering the DPF 15 is typically in the range of 6 to 15% but by the application of the load from the integrated starter-generator 16 this may be reduced to 3 to 5%. This reduction in Oxygen level in the exhaust gas entering the DPF 15 will slow the rate of soot combustion within the DPF 15 and so the temperature of the DPF 15 will be reduced.

Figure 2:
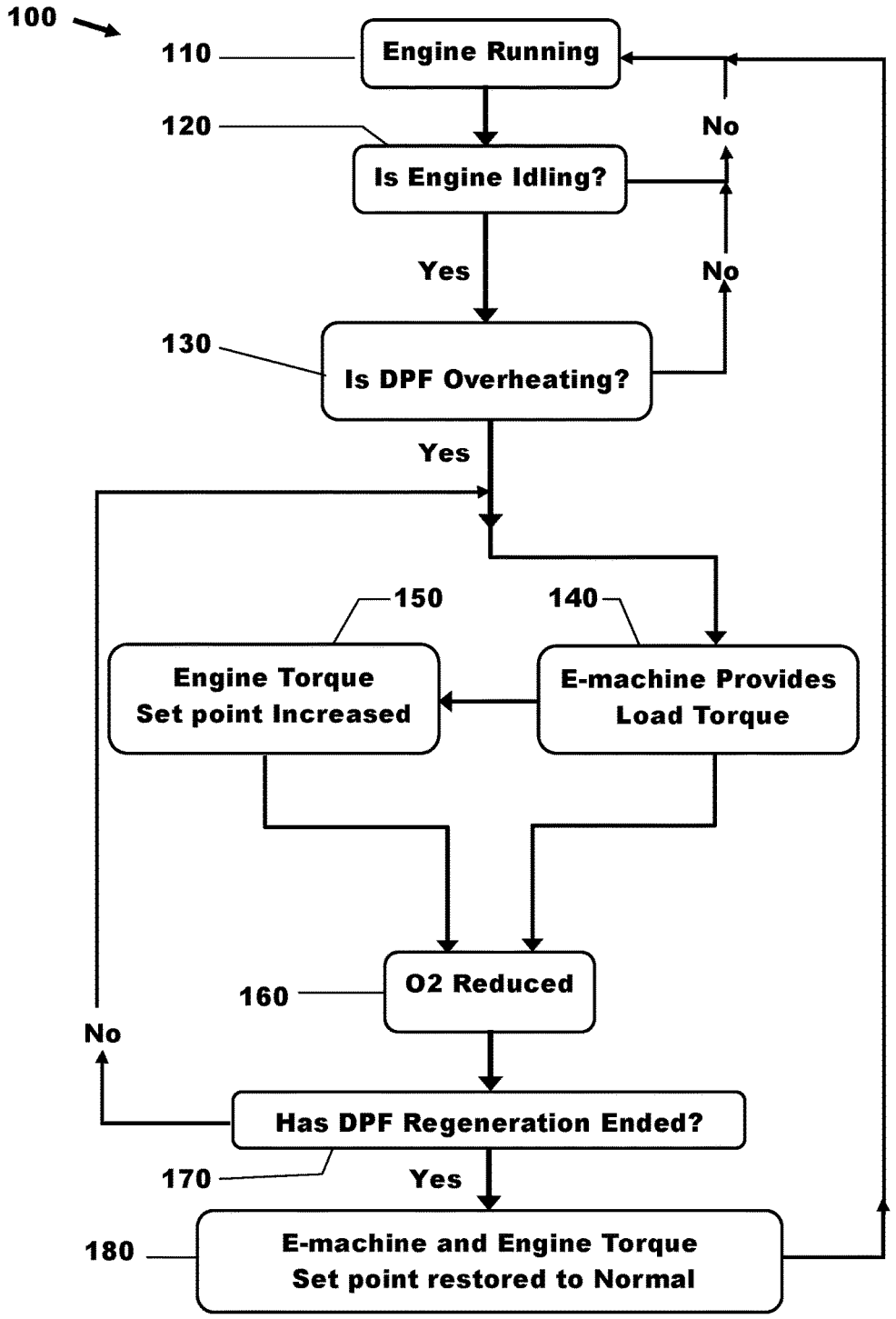
FIG. 2 is a high level flow chart of a method in accordance with an embodiment.

With reference to FIG. 2 there is shown a method 100 for protecting a diesel particulate filter when an engine from which exhaust gas is received by the diesel particulate filter is idling. The method starts in box 110 with the engine 10 running and then in box 120 it is checked whether the engine 10 is idling.

If the engine 10 is not idling the method returns to box 110 and, if the engine 10 is idling, the method advances from box 120 to box 130 where it is checked whether the DPF 15 is overheating. As previously described this can be achieved by using a temperature sensor 28 to measure the temperature of the exhaust gas exiting the DPF 15.

However, as an alternative to this approach the temperature within the diesel particulate filter can be modelled or to be more precise a model of the soot combustion process can be used to estimate the temperate within the DPF 15. The use of such a soot combustion model has the advantage that there will be no delay between the time the temperature in the DPF 15 is predicted to be excessive and the start of temperature controlling by the electronic controller 20 whereas there is a delay when the increase is sensed by the downstream temperature sensor 28 because the temperature of the exhaust gas has to increase before its increase can be sensed and so the system then acts reactively. If a soot combustion model such as that disclosed in US Patent Application 2012/0031080 is used then the increase in temperature can be predicted so the system can act proactively resulting in the steps to control the temperature being taken sooner. As before, if the prediction indicates that the temperature within the DPF 15 is likely to be unacceptably high that is to say, above a predefined limit, then the DPF 15 may be overheating.

If the result of the check in box 130 is that the DPF 15 is not currently overheating, the method returns to box 110 and will then proceed as previously described unless a vehicle key-off event occurs whereupon it ends.

However, if when checked in box 130 the result is that the DPF 15 is overheating or, if a soot combustion model is used, that DPF overheating is imminent then the method advances to box 140.

In box 140 the electric machine which in this case is the integrated starter-generator 16 driven by the engine 10 is switched into a battery charging mode. This will cause a load in the form of torque to be applied to the engine 10.

This would normally cause the engine speed to reduce but, due to an idle speed control system that is formed in this case as part of the electronic controller 20, the result of the application of the applied torque in box 140 is for the engine torque set point to be increased as indicated in box 150 to maintain the idle speed at the desired speed. The effect of increasing the engine torque set point is to increase the torque output from the engine 10 by injecting more fuel in the engine 10. That is to say, the air-fuel ratio (represented by Lambda) is reduced making the composition of the exhaust gas flow richer and reducing the amount of Oxygen in the exhaust gas flow to the DPF 15 as indicated in box 160.

From box 160 the method advances to box 170 to check whether DPF regeneration has ended. If DPF regeneration has ended then the method advances to box 180 where the integrated starter-generator 16 is returned to normal operation and the engine torque set point is restored to normal and the method then returns to box 110 and all subsequent steps are repeated unless a key-off event has occurred whereupon it ends.

However, if when checked in box 170, DPF regeneration has not ended, the method returns to boxes 140 and 150 and the reduction of Oxygen supply to the engine 10 continues.

Figure 3:
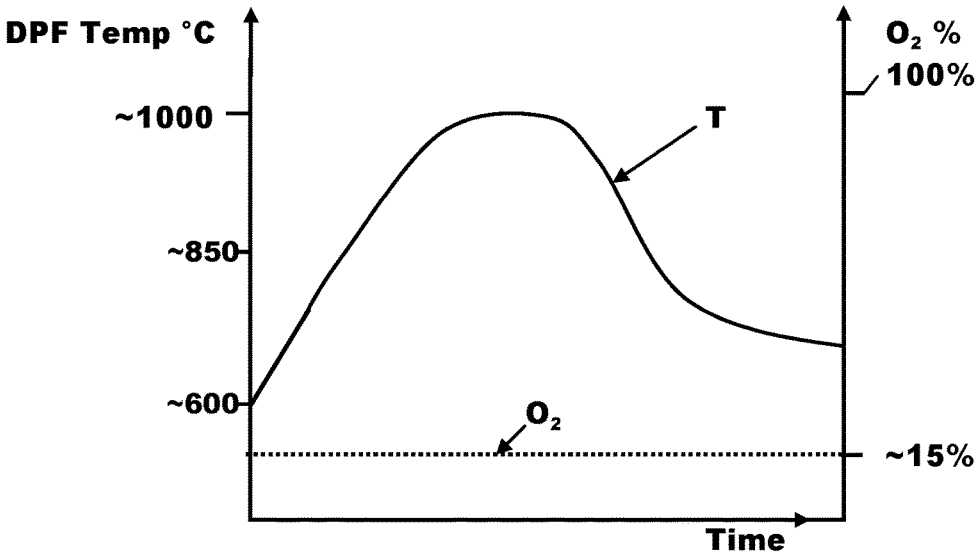
Prior Art Fig.3
FIG. 3 is a composite chart showing a prior art relationship between temperature and time for a DPF during a regeneration event when an engine is idling and the relationship between Oxygen concentration and time for the same event.
Figure 4:
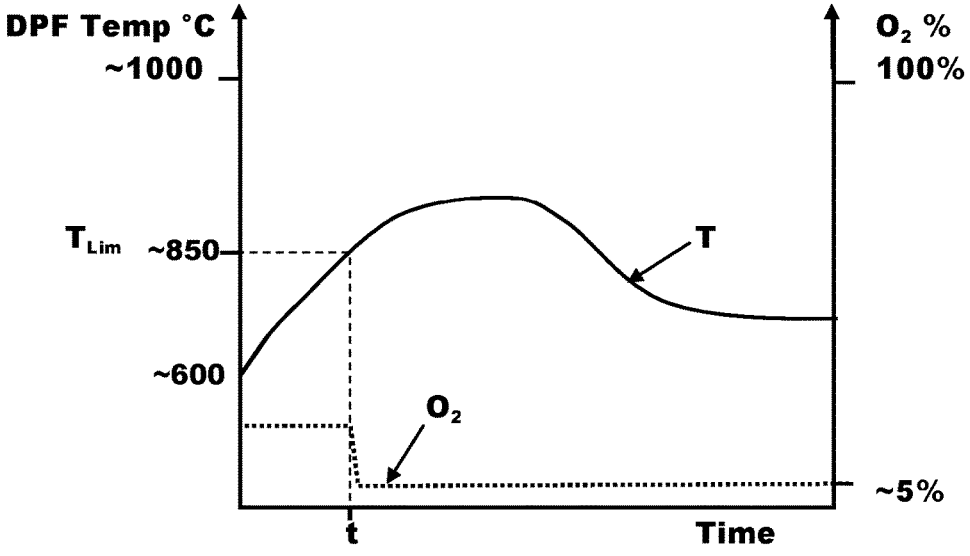
FIG. 4 is a composite chart showing a relationship between temperature and time for a DPF during a regeneration event when an engine is idling in accordance with embodiments of the disclosure and the relationship between Oxygen concentration and time for the same event.

The effect of carrying out a method in accordance with various embodiments can be seen by comparing the prior art situation shown in FIG. 3 with the situation when the method 100 is used as shown in FIG. 4.

In the prior art case of FIG. 3, idling of the engine results in an Oxygen concentration in the exhaust gas of circa 15% as indicated by the line ($O_2$) resulting in a rapid increase in temperature (T) within a DPF due to the availability of Oxygen to fuel combustion of the soot.

In the case of one embodiment using temperature sensor control as illustrated in FIG. 4, engine idling initially produces an Oxygen concentration ($O_2$) of circa 15% resulting in a sudden increase in DPF temperature until, at time 't', temperature control is initiated. That is to say, the temperature of the exhaust gas exiting the DPF 15 has reached the predefined temperature limit $T_{lim}$ which in this case is set at 850° C.

Therefore, at the time 't', torque is applied by the integrated starter-generator 16 to the engine 10 and the engine torque set point correction is made. After making these changes the Oxygen concentration falls to circa 5% resulting in a reduction in the increase in temperature (T) within the DPF 15 due to the limited availability of Oxygen to fuel combustion of the soot in the DPF 15.

Although embodiments have been described with reference to a hybrid vehicle having an integrated starter-generator, it will be appreciated that it could be applied with benefit to other vehicles having an electric machine with sufficient generating capacity to produce the required load to force an increase in engine output torque to maintain a stable idle speed and the consequential reduction in the Oxygen concentration of the exhaust gas flowing to the diesel particulate filter.

It will be appreciated by those skilled in the art that although the claimed subject matter has been described by way of example with reference to one or more embodiments it is not limited to the disclosed embodiments and that alternative embodiments could be constructed without departing from the scope of the disclosure as defined by the appended claims.

While representative embodiments are described above, it is not intended that these embodiments describe all possible forms of the claimed subject matter. Rather, the words used in the specification are words of description rather than limitation, and it is understood that various changes may be made without departing from the spirit and scope of the disclosure. Additionally, the features of various implementing embodiments may be combined to form further embodiments that are not explicitly described or illustrated. While various embodiments may have been described as providing advantages or being preferred over other embodiments or prior art implementations with respect to one or more desired characteristics, as one of ordinary skill in the art is aware, one or more features or characteristics may be compromised to achieve desired overall system attributes, which depend on the specific application and implementation. These attributes include, but are not limited to: cost, strength, durability, life cycle cost, marketability, appearance, packaging, size, serviceability, weight, manufacturability, ease of assembly, etc. Embodiments described as less desirable than other embodiments or prior art implementations with respect to one or more characteristics are not necessarily outside the scope of the disclosure and may be desirable for particular applications.

What is claimed is:

1. A method of controlling a vehicle having an electric machine and a diesel particulate filter (DPF) coupled to an engine, comprising:

in response to a DPF temperature exceeding a threshold during regeneration of the DPF while the engine is in idle mode, operating, by a controller, the electric machine in a generator mode to increase engine load and adjusting fueling to the engine to compensate for the engine load increase.

2. The method of claim 1 wherein adjusting the fueling to the engine comprises reducing an air-fuel ratio to increase richness of an air-fuel mixture supplied to the DPF.

3. The method of claim 1 further comprising checking engine speed to confirm that the engine is operating in the idle mode.

4. The method of claim 1 further comprising using a soot combustion model to predict the DPF temperature within the DPF.

5. The method of claim 1 further comprising measuring the DPF temperature using a temperature sensor to measure one of a temperature within the DPF and a temperature of exhaust gas exiting the DPF.

6. The method of claim 1 wherein the electric machine comprises an integrated starter-generator.

7. A vehicle comprising:

a diesel engine;

an electric machine connected to the engine;

a battery connected to the electric machine;

a diesel particulate filter (DPF) arranged to receive engine exhaust gas; and a controller programmed to control the engine and the electric machine to reduce oxygen content of the engine exhaust gas in response to a DPF temperature exceeding a threshold during DPF regeneration while the engine is idling.

8. The vehicle of claim 7 wherein the controller is further programmed to increase engine torque and maintain engine speed by operating the electric machine as a generator to charge the battery.

9. The vehicle of claim 7 wherein the controller is further programmed to adjust engine fueling to reduce the oxygen content of the engine exhaust gas.

10. The vehicle of claim 7 wherein the electric machine comprises an integrated starter-generator.

11. The vehicle of claim 7 further comprising a temperature sensor in communication with the controller to measure the DPF temperature.

12. The vehicle of claim 11 wherein the temperature sensor is arranged to measure temperature of exhaust downstream of the DPF.

13. The vehicle of claim 7 wherein the controller is programmed to predict the DPF temperature using a soot combustion model.

14. The vehicle of claim 7 wherein the controller is programmed to reduce an engine air-fuel ratio to increase richness of a mixture supplied to the diesel particulate filter.

15. A method for controlling a vehicle having an electric machine, an engine, and a diesel particulate filter (DPF), comprising:

by a controller, in response to the engine entering an idle mode during regeneration of the DPF, operating the electric machine to increase engine load and increasing engine torque in response to the engine load increase to reduce oxygen content of exhaust gas entering the DPF.

16. The method of claim 15 wherein operating the electric machine comprises operating the electric machine as a generator to charge a battery.

17. The method of claim 15 further comprising adjusting an air-fuel ratio of the engine to increase engine torque.

18. The method of claim 17 wherein adjusting the air-fuel ratio comprises adjusting engine fueling.

19. The method of claim 15 wherein the electric machine comprises an integrated starter-generator.

20. The method of claim 15 further comprising controlling engine speed to maintain idle speed while operating the electric machine to increase engine load.

* * * * *